US007260334B2

(12) United States Patent
Winter et al.

(10) Patent No.: US 7,260,334 B2
(45) Date of Patent: Aug. 21, 2007

(54) METHOD FOR CONTROLLING A PRINTER OR COPIER USING A TONER MARK BAND AND REFLEX SENSOR WORKING ACCORDING TO THE TRIANGULATION PRINCIPLE

(75) Inventors: Hans Winter, München (DE); Volkhard Maess, Pliening (DE); Heinrich Lay, Töging (DE); Rüdiger Hauns, Markt Schwaben (DE); Arno Best, Lohhof-Unterschleissheim (DE); Michael Mayr, München (DE); Ulrich Bäumler, Poing (DE); Thomas Schimidt-Behounek, Ebersberg (DE); Wolfgang Schullerus, Raubling (DE); Josef Schreieder, Malgersdorf (DE); Uwe Höllig, München (DE)

(73) Assignee: Oce Printing Systems GmbH, Poing (DE)

( * ) Notice: Subject to any disclaimer, the term of this patent is extended or adjusted under 35 U.S.C. 154(b) by 475 days.

(21) Appl. No.: 10/485,537

(22) PCT Filed: Jul. 31, 2002

(86) PCT No.: PCT/EP02/08563

§ 371 (c)(1),
(2), (4) Date: Aug. 27, 2004

(87) PCT Pub. No.: WO03/012552

PCT Pub. Date: Feb. 13, 2003

(65) Prior Publication Data

US 2006/0251436 A1 Nov. 9, 2006

(30) Foreign Application Priority Data

Aug. 2, 2001 (DE) ..... 101 37 861

(51) Int. Cl.
*G03G 15/00* (2006.01)

(52) U.S. Cl. ..... 399/49; 347/19; 399/72; 399/301

(58) Field of Classification Search ..... 399/49, 399/72, 9, 301, 394; 347/19; 358/406, 504
See application file for complete search history.

(56) References Cited

U.S. PATENT DOCUMENTS

| | | | | |
|---|---|---|---|---|
| 4,684,243 | A | 8/1987 | Minor | 399/72 |
| 5,483,328 | A | 1/1996 | Kawasaki et al. | 399/49 |
| 5,842,088 | A | 11/1998 | Thompson | 399/177 |
| 5,995,802 | A | 11/1999 | Mori et al. | 399/394 |
| 2003/0085940 | A1* | 5/2003 | Yamada | 347/19 |
| 2003/0142985 | A1* | 7/2003 | Sampath et al. | 399/9 |

FOREIGN PATENT DOCUMENTS

| | | |
|---|---|---|
| DE | 2 139 324 | 2/1973 |
| EP | 0 291 738 | 11/1988 |
| EP | 0 482 866 A2 | 4/1992 |
| EP | 0 864 931 A1 | 9/1998 |
| JP | 2000221738 | 8/2000 |
| WO | WO 00/34831 | 6/2000 |

* cited by examiner

*Primary Examiner*—Sophia S. Chen
(74) *Attorney, Agent, or Firm*—Schiff Hardin LLP

(57) ABSTRACT

A method and device controls a printer or copier to generate a plurality of marks that are assembled into a coherent marking band that is then inked by the toner. A sensor measures the marking band. The printer or copier are controlled based on the output of the sensor.

57 Claims, 7 Drawing Sheets

METHOD FOR CONTROLLING A PRINTER OR COPIER USING A TONER MARK BAND AND REFLEX SENSOR WORKING ACCORDING TO THE TRIANGULATION PRINCIPLE

BACKGROUND OF THE INVENTION

1. Field of the Invention

The invention concerns a method to control a printer or copier, in that marking data for toner markings for a character generator are stored in an image control, and in that the character generator generates in an intermediate carrier a latent image corresponding to the marking data that is inked with toner material in the further course, whereby toner marks are generated on the intermediate carrier. Furthermore, the invention concerns a device to implement this method.

Furthermore, the invention concerns a method to control a printer or copier using an optical reflex sensor, as well as a device for this.

2. Description of the Related Art

In order to print a print image on a print medium (for example paper) with consistent inking, a permanent monitoring and regulation of the electrophotographic or electromagnetic processes is necessary. For this monitoring and regulation, different toner marks adapted to the respective processes are applied to the intermediate carrier (that is, for example, an organic photoconductor band, also called an OPC band (OPC organic photoconductor)) or to a transfer band; these toner marks are scanned with the aid of sensors and the results used to control the print process. For example, the blackening of the toner mark can be measured with the aid of a reflex sensor. Another possibility is to detect the toner layer thickness with the aid of a capacitive layer thickness sensor. Another method utilizes the electric toner charge, whereby the charge potential is measured with the aid of a potential sensor. The problem exists in these procedures to apply different markings to the intermediate carrier independent of the print image to be printed and independent of a temporal control, and to synchronize these toner markings with the evaluation by the sensor or sensors.

SUMMARY OF THE INVENTION

It is the object of the invention to provide a method and a device with whose help a control of the print processes can be implemented in a simple manner and given different print processes, under evaluation of the toner markings.

An electrophotographic printing device is known from PCT Published Application WO 00/34831 by the same applicant in which two printing units print images onto a transfer band that transfers these images in the further course to a carrier material (for example paper). With the aid of a character generator associated with the first printing unit, a marking is printed on the transfer band by the first printing unit at the beginning of each image. Using this marking, the run time for the image from its generation can be precisely determined.

It is known from European Patent Document EP-A-0 291 738 to print toner markings according to a type of a cross on both sides of images. With the aid of these markings, a lateral shifting of the images with regard to the band carrying the images can be determined.

U.S. Pat. No. 5,995,802 specifies a printing device in which a plurality of printing units are arranged and print images on a transfer band with different colors for a 4-color print. A plurality of markings pertaining to the primary colors black, yellow, magenta and cyan are printed outside of the actual print region and have been evaluated for the process control.

This object is achieved for a method to control a printer or copier, in that marking data for toner markings for a character generator are stored in an image control; the character generator generates on an intermediate carrier a latent image corresponding to the marking data that is inked with toner material in the further course; a plurality of markings are combined in the image control into a coherent marking band, whereby each marking has a spatially defined position within the marking band on the intermediate carrier; and that the inked toner markings of the marking band are scanned by at least one sensor whose signal is used to control the print process.

According to the invention, a plurality of markings that are necessary for the different electrophotographic or electromagnetic print processes are deposited in a marking band. Accordingly, only one or more marking bands must be accessed for the various electrophotographic or electromagnetic processes of a device type, and the character generator must be correspondingly controlled in order to print the necessary toner markings. In this manner, the technical expenditure is minimized and the handling with toner markings is standardized.

A further aspect of the invention concerns the evaluation of the toner markings by means of a sensor system. As already addressed further above, given a print process in an electrophotographic or electromagnetic printer or copier, the color density of inked surfaces, achieved with the aid of toner, depends on a plurality of process parameters. A substantial influence comes from the thickness of the toner coating achieved during the image development on the intermediate carrier (for example the photoconductor), which itself in turn can depend on a plurality of further process parameters such as, for example, the specific surface charge of the toner or the potential difference between the photoconductor surface and the surface of a donor element. For a qualitative high-grade print image, the print process must be able to maintain the optical density within narrow limits over a relatively long period of time. For this purpose, in many electrophotographic printers one or more toner markings are generated on the intermediate carrier at regular temporal intervals, for the most part in a region that is normally not transfer printed. These toner markings are then recorded by sensors and evaluated in order to influence, for example, the important operating quantities of the average toner mass allocation with regard to the surface.

For evaluation of toner markings, it is general prior art to use optoelectronic reflex sensors that radiate radiation on to surface of the toner marking to be measured and that absorb and evaluate radiation reflected from this toner marking surface, as well as from the intermediate carrier surface (for example the surface of the photoconductor) lying beneath it. This measurement principle enables a sufficiently high precision, as long as the following requirements are met: the toner markings form no closed, opaque toner layer, but rather comprise punctiform, permeable locations, for example holes; the color of the toner offers, in the wavelength range of the reflex sensor, a sufficiently strong contrast to color and/or brightness of the surface of the intermediate carrier; the reflection properties of the surface of the intermediate carrier are uniform and temporally unchanging. Given very high optical densities on the print substrate or carrier material, the toner layer is opaque for the reflex sensor; this means that a reliable conclusion about the actual mass allocation with toner material is impossible.

Furthermore, the principle of capacitive measurement value detection is known that detects the change of the dielectric between capacitor electrodes given a pass through a toner marking. This sensor principle requires a significant circuitry and signal processing effort in order to reliably detect capacitance changes in the femto-Farad range. Changes or, respectively, fluctuations of the dielectric properties of the toner material or, respectively, of the intermediate carrier (for example the photoconductor) must be compensated with the aid of calibration procedures.

According to the further aspect of the invention, a method to control a printer or copier is specified in which an optical reflex sensor that determines the thickness of the toner layer of the toner marking according to the triangulation method is used as a sensor to scan the respective toner marking, whereby the print process is controlled dependent on the determined thickness of the toner layer.

In the invention, the toner mass coating with regard to the surface can be directly inferred from the thickness of the toner marking. This mass coating is a direct input quantity to control the various parameters of the print process. In this manner, the quality of the print process can be further improved. Given the inventive method, very thick and optically opaque toner layers can thus also be evaluated.

BRIEF DESCRIPTION OF THE DRAWINGS

Exemplary embodiments of the various aspects of the invention are explained in the following using the drawing.

DETAILED DESCRIPTION OF THE PREFERRED EMBODIMENTS

Figure 1:
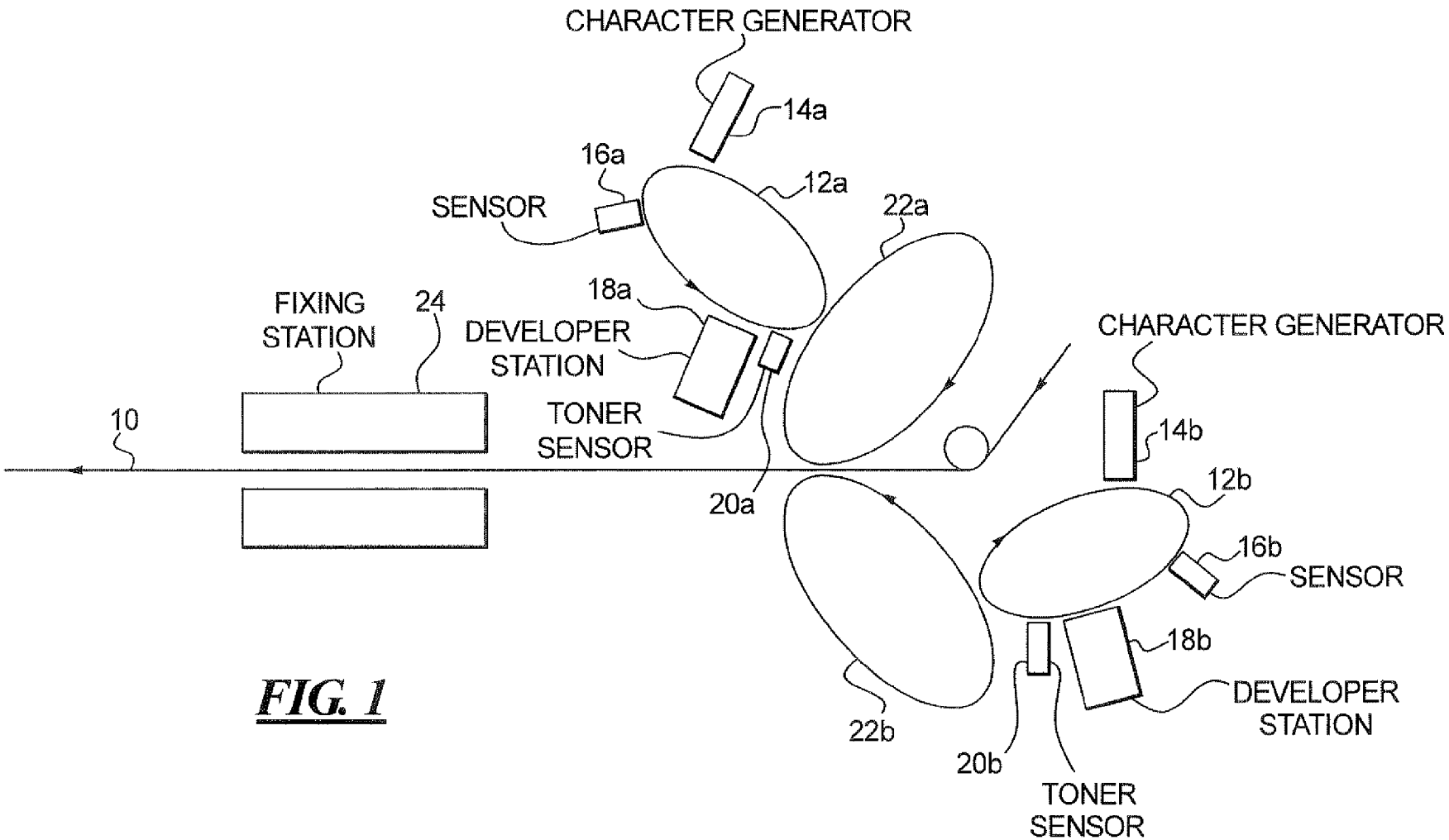
FIG. 1 is a schematic diagram showing the principle assembly of a printer that can print print images on both sides of a carrier material.

FIG. 1 shows a printer that operates according to the electrophotographic printing principle. A carrier material 10, for example a paper web, is simultaneously printed double-sided. An upper character generator 14*a* generates a latent image on an upper photoconductor band (also called an OPC band). The character generator 14*a* also generates the toner marking bands with the toner markings. A potential sensor 16*a* detects the charge potential of the band and of the latent image and the band; its signal is further used for process control. An upper developer station 18*a* inks the latent image with the print images and the toner markings with toner material. Viewed in the running direction of the photoconductor band 12*a*, a toner marking sensor 20*a* that evaluates the toner markings is downstream after the developer station 18*a*. The toner image applied to the photoconductor band 12*a* is transferred to an upper transfer band 22*a*, and from there transfer printed on the top of the carrier material 10.

The bottom of the carrier material 10 is printed in a similar manner, wherefore the similarly assembled and similarly arranged function units (namely lower photoconductor band 12*b*, lower character generator 14*b*, lower potential detector 16*b*, lower developer station 18*b*, lower toner marking sensor 20*b* and lower transfer band 22*b*) are used. The carrier material 10, thus printed simultaneously and on both sides, is simultaneously fixed on top and bottom and output in a fixing station 24. The shown assembly of the upper printing unit and the lower printing unit is suitable to print a plurality of color separations. For this, the respective transfer band 22*a*, 22*b* assembles a plurality of toner layers of different colors of a print image one atop the other, and then prints this on the carrier material 10. The following describe examples of toner bands, their evaluation and the varying device-technical assembly can be used for the printer shown in FIG. 1.

Figure 2:
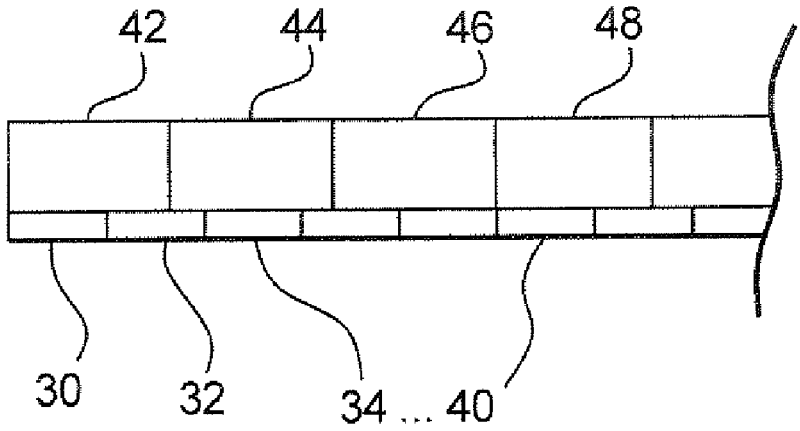
FIG. 2 is a schematic diagram showing marking bands and print images in which the beginning of the first marking band is synchronized with the beginning of the first print side.

FIG. 2 shows the assembly of marking bands 30 through 40 that belong to the print images 42 through 48. A plurality of toner markings is comprised in each marking band 30 through 40. Each marking has a spatially defined position within the marking band 30 through 40. The marking bands 30 through 40 are applied to the intermediate carrier in a region that typically lies outside of the print image to be printed, for example along an edge track. In this manner, the print images 42 through 48 are not disturbed. Alternatively, it is possible to apply the marking bands to the intermediate carrier in a region that lies within the print image to be printed. It is thereby possible to be able to execute test functions and compensation functions in the setup and test run of the printer.

In the example according to FIG. 2, in every print start the beginning of the first marking band 30 is synchronized with the beginning of the first print side 42. The following marking bands 32 through 40 are then attached together without interval, meaning only the first marking band is synchronized to the first print side 42; all other marking bands 32 through 40 are asynchronous to the further print sides 44 through 48. The advantage of this arrangement is that the length of the respective marking band can be independent of the length of the print sides; expressed differently, the length of the marking bands 30 through 40 can be selected arbitrarily long, independent of form. In such a case, the form lengths can be different and arbitrarily long. The form length has no influence on the required process regulation that is undertaken with the aid of the toner markings of the marking bands 30 through 40. What is disadvantageous in this version is that the device control must administrate every beginning of the individual marking bands 30 through 40 dependent on the print sides 42 through 48.

Figure 3:
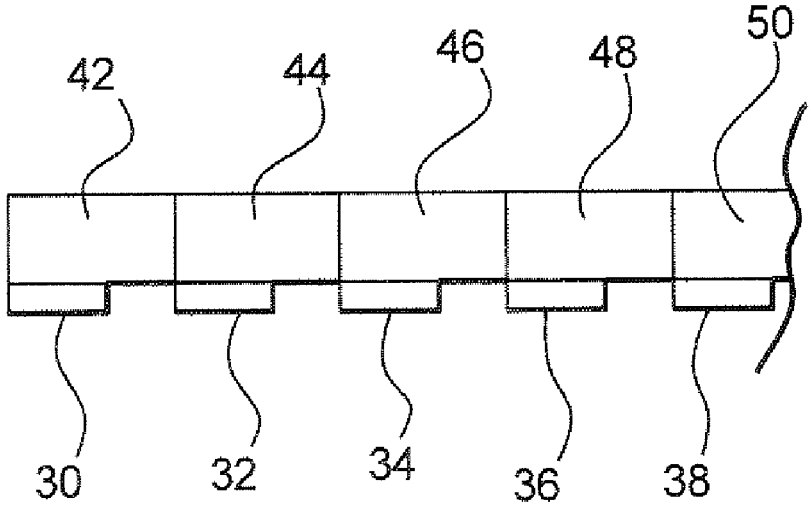
FIG. 3 is a schematic diagram marking bands and print images in which each marking band is synchronized with the beginning of each print side.

FIG. 3 shows another variant in which the marking bands 30 through 38 are respectively synchronized with the beginning of every print side 42 through 50. It is hereby advantageous that the beginning of a respective marking band 30 through 38 and the beginning of a respective print image 42 through 50 can be triggered together. It can be disadvantageous that the length of the respective marking band 0 through 38 can maximally be the length of the respective print image 42 through 50; a limitation dependent on the length of the print image thus exists for the marking bands. Given very long forms, it can ensue that the length of the associated marking band is very short with regard to the length of the form, such that a precise regulation of the electrophotogaphic process over the large length of the print image is not ensured. A solution for this problem proposes that a plurality marking bands be added within such a long print side, such that the maximum separation between successive marking bands is not too great, for example not greater than approximately 50 cm (20 inches).

Figure 4:
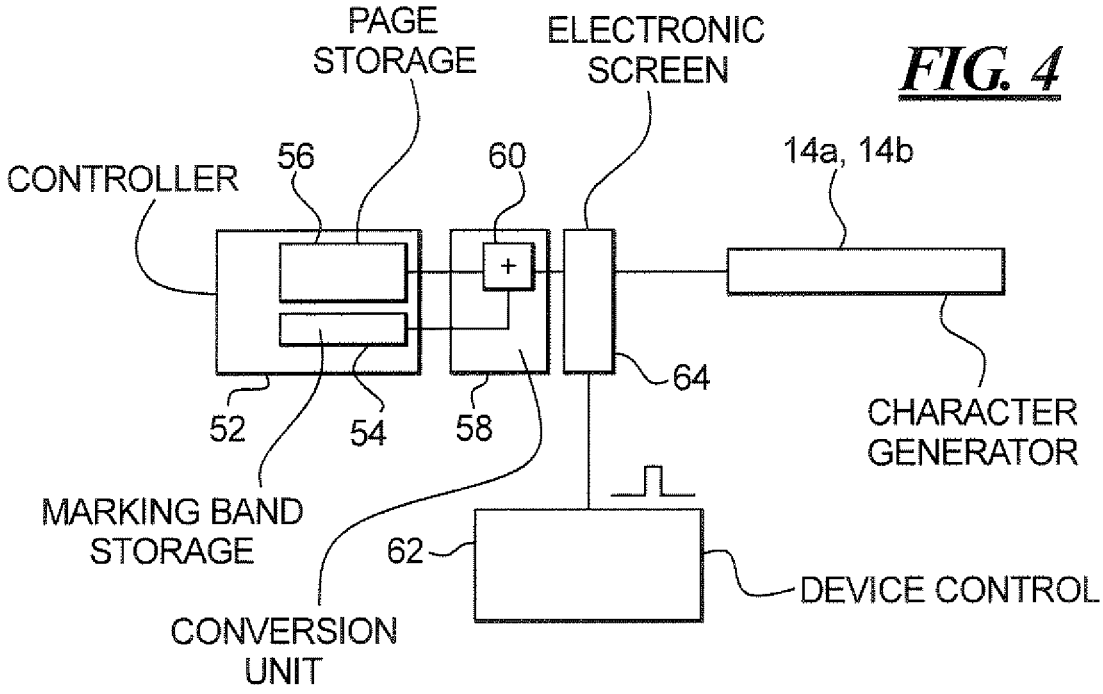
FIG. 4 is a functional block diagram with various function units, whereby the data for the various marking bands are asynchronously added in the transfer of the print data to the character generator.

FIG. 4 shows a block diagram with various function units. The character generator (for example the character generator 14*a* or 14*b* according to FIG. 1) receives data from control units for the print images and for the marking bands. A controller 52 accesses a marking band storage 54 in which data are stored about the marking bands, and a page storage 56 in which the data for the print images of the print pages are stored. The rastering of the data ensues individually in the controller for each page and for the marking band, i.e. one bitmap is created for the print side and one bitmap is created for the marking band. The controller 52 transfers the data of the bitmap to a conversion unit 58 in which the bitmap data of the page storage 56 and the data of the marking band storage 54 are combined (indicated by an addition block 60). The data of the marking bands are thus added in the transfer of the print data to the character generator 14*a*, 14*b*. A device control 62 controls an electronic screen 64, such that, process-specifically from the marking bands, the necessary toner markings are connected through in data form; the other toner markings are filtered out. In this manner marking bands can be arbitrarily changed without print sides being changed. Given a restart of the print operation after a stop, in this variant only the data of the marking band must be newly rastered; the bitmap data of the respective print side remain unchanged. In this manner, the processing speed upon creation of the bitmap in the controller 52 is increased.

Figure 5:
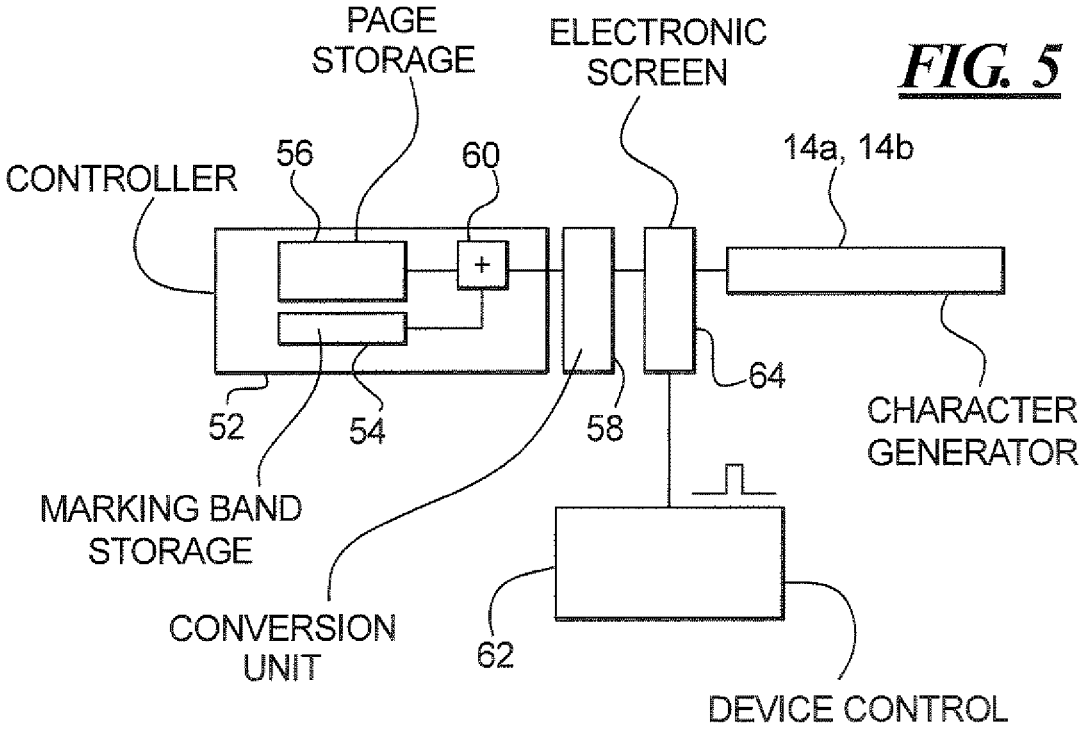
FIG. 5 is a functional block diagram with various function units, whereby the data for the various marking bands are asynchronously or synchronously added to the print image before the rastering in the controller.

FIG. 5 shows another variant in which identical parts are designated identically. Before the rastering in the controller 52, in which (as expected) a bitmap of the pixel to be printed is generated, the data of the various marking bands are asynchronously or synchronously linked to the data of the respective print image.

It is hereby to be noted that, given the linking thereto of the marking bands in the center track, the print image of the original side is erased in the track area, whereby toner markings and print image of the original side are not mixed. In the arrangement according to FIG. 5, the print side must also be newly rastered given each change of the marking band.

The electronic screen 64 has, as noted, the objective to filter out unnecessary toner markings in the toner bands. This is necessary so that such unnecessary toner markings are not transferred to the carrier material, because they would then have to be completely removed (meaning purged) by a subsequent cleaning station. Such a purging is, however, elaborate and not absolutely reliable. It is therefore important to only write the actually necessary toner markings in the edge track.

Figure 6:
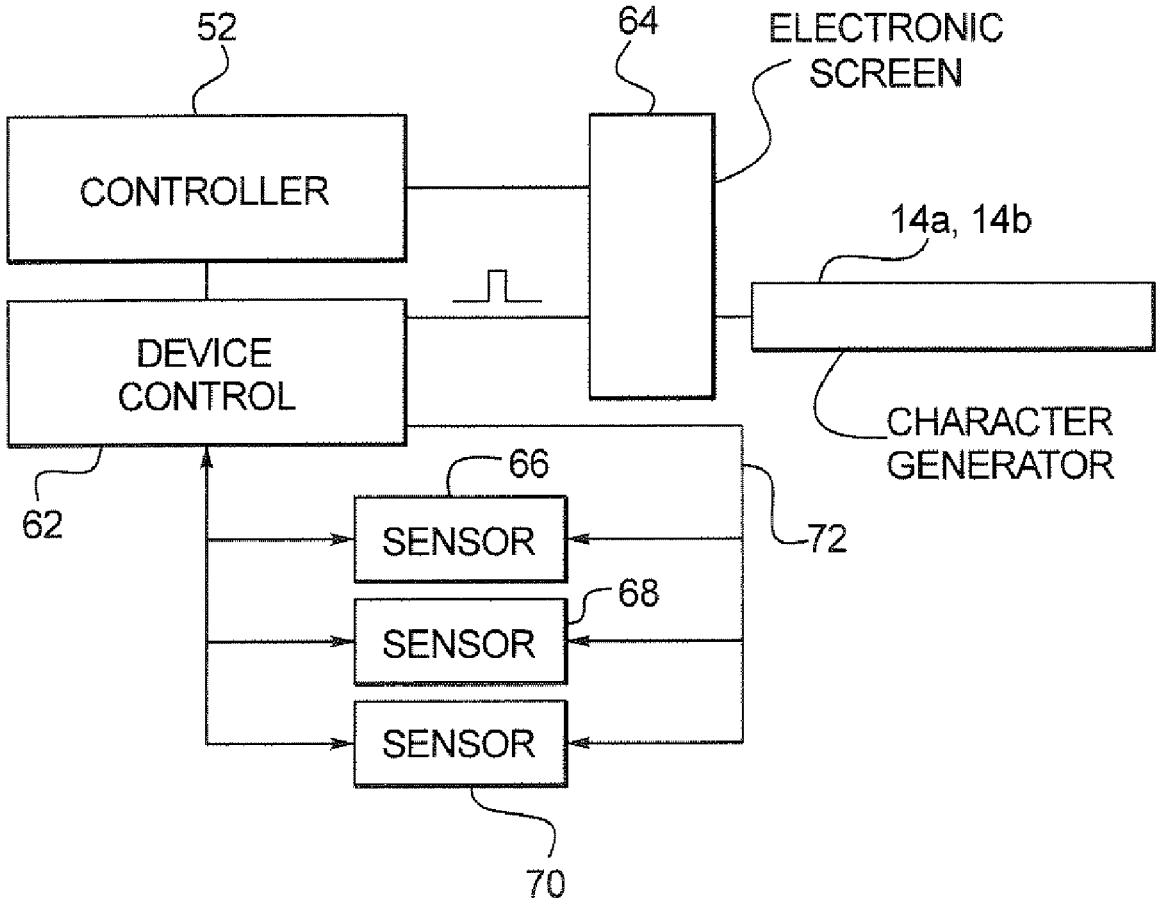
FIG. 6 is a functional block diagram with various function units) whereby the markings are read with the aid of different sensors.

The toner markings on the photoconductor band 12*a*, 12*b* are evaluated with the aid of sensors. FIG. 6 shows the use of three different sensors 66, 68, and 70. Since the different toner markings must be firmly associated with these various sensors 66, 68, and 70, it must also be assured that each sensor measures only the toner marking specific to it. To synchronize the writing of the toner marking and the reading of the toner marking, a trigger pulse is generated by the device control for the sensors 66, 68, and 70 via the line 72 at every beginning of the respective marking band. At the start of the writing of the respective toner marking, the time offset to the trigger pulse on the line 72 is stored by the device control 62 and communicated to the respective sensor 66, 68, and 70 that should evaluate this marking. Since the device control knows at every point in time the location of the respective marking band, and the location of the toner marking therein with regard to the respective sensor 66, 68, and 70, it can communicate to each sensor 66, 68, and 70 the point in time of the passage of the respective marking. Each sensor 66, 68, and 70 can hereby evaluate a plurality of toner markings in succession.

Numerous variants of the specified exemplary embodiments according to FIGS. 1 through 6 are possible. For example, it is possible to evaluate with the aid of sensors toner markings that are printed on the transfer band 22*a*, and 22*b*. Furthermore, marking data can be stored for a plurality of toner markings; a marking band or a plurality of marking bands can then be assembled from this plurality of toner markings, whereby an associated marking band is selected dependent on the selected print process. In this manner, all toner markings can be prepared for different types of a device type and combined into marking bands. With the aid of the electronic screen, it is then possible to select the actual required toner markings on the marking bands.

In a further alternative, a single marking band is defined whose toner markings permit the plurality of print processes of a device type to control the printer or copier. This measure serves for the unification and the simpler software-technical handling with the toner markings.

In the exemplary embodiment according to FIG. 1, two printing units with respectively one transfer band are provided within a single device, whereby the upper transfer band 22*a* provides the top of the carrier material 10 with a toner image, and the lower transfer band 22*b* likewise provides the bottom of the carrier material with a toner image. Marking bands with toner markings are applied to each transfer band. According to a development, the application of the marking bands on both of the transfer bands 22*a*, and 22*b* ensues such that two toner markings inked with toner are not simultaneously juxtaposed at the common transfer printing location for both transfer bands 22*a*, and 22*b*. In this manner, the problem of the creation of toner dust is avoided. The toner markings of the toner bands namely lie in the edge track outside of the carrier material. If the toner marking of the upper transfer band and the toner marking of lower transfer band were to now come in contact in this edge zone, due to a lack of paper in this region, toner dust would thus ensue. The cited development prevents this problem.

A further problem can ensue if the same toner marking were always to be written at the same location of the photoconductor band. This can lead to a memory effect in the photoconductor band and change the inking of the toner marking. Therefore) in a development of the invention it is ensured that the length of the respective marking band is not a multiple of the length of the photoconductor band.

Figure 7:
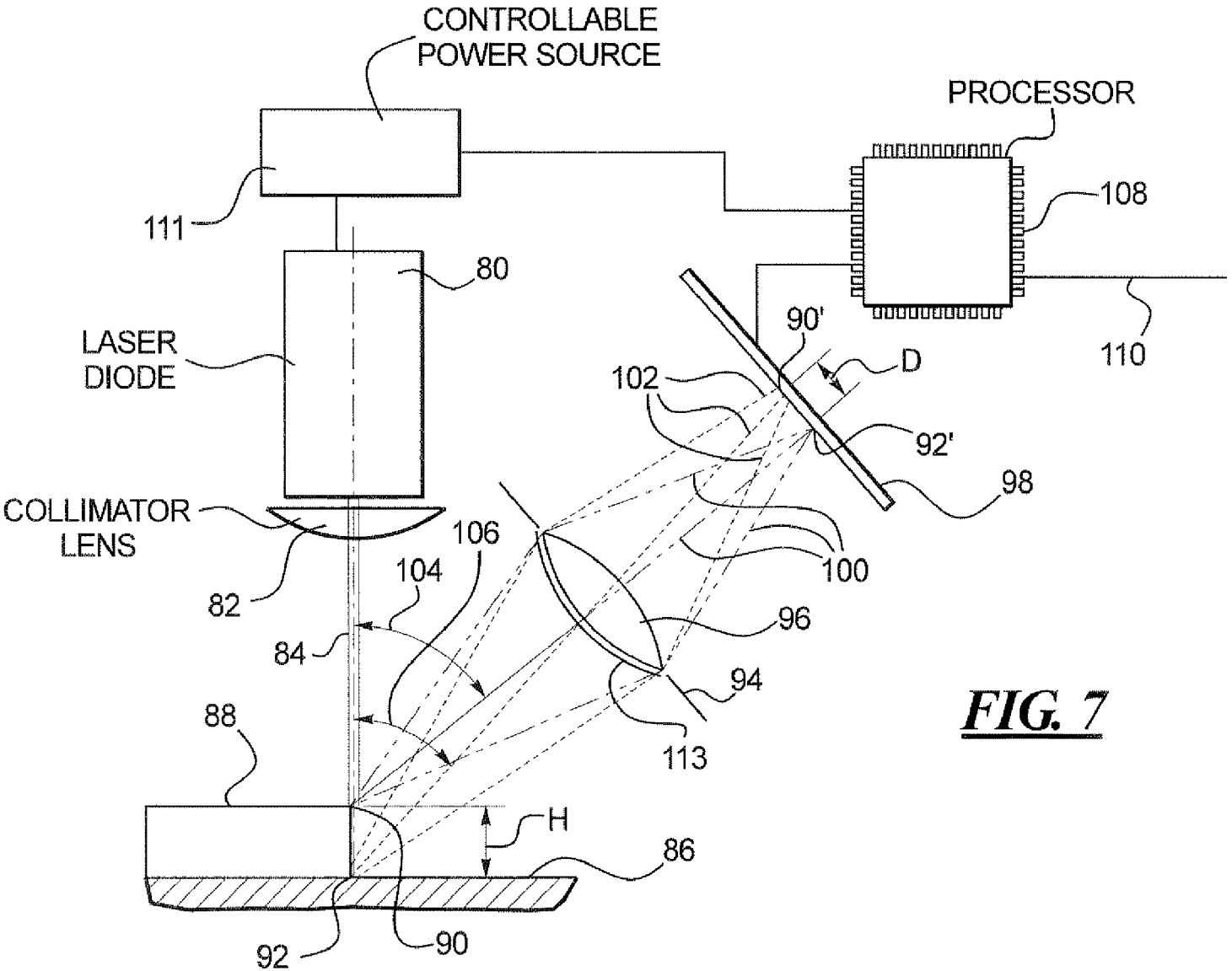
FIG. 7 is a schematic diagram showing the principle assembly of a reflex sensor applying the triangulation principle.

FIG. 7 shows in a principle view an optical reflex sensor to scan the toner marking, as can for example be used as a toner marking sensor 20*a*, and 20*b* according to FIG. 1. The reflex sensor comprises as a radiation source a laser diode 80 whose radiation is concentrated into a scanning beam 84 by a collimator lens 82. The laser diode 80 radiates monochromatic radiation, for example in the range of the near-infrared. However, other wavelength ranges of the radiation can also be used.

The scanning beam 84, which is arranged to be incident on the carrier in a substantially perpendicular direction, impinges on the respective surface in the passage of the intermediate carrier 86 with the toner marking 88. It is shown in FIG. 7 that the scanning beam 84 impinges half on the surface of the toner marking 88 and half on the surface of the intermediate carrier 86 (for example a photoconductor band) and there respectively generates a measurement spot 90 or, respectively, 92. The measurement spots 90, and 92 are typically smaller than 1 $mm^2$. The radiation is diffusely reflected in a substantial part by the respective measurement spot 90, and 92. Imaging optics 96 (for example a convex lens) bounded by a screen 94 image the measurement spots 90, and 92 on a linear detector array 98 as measurement spot 90', and 92'. The imaging radiation beam of the measurement spot 90 is indicated in FIG. 7 with a dash-dot pattern and has the reference number 100. The radiation beam originating from and imaging the measurement spot 92 is indicated dashed in FIG. 7 and has the reference number 102.

The measurement spots 90, and 92 have a perpendicular separation H from one another, corresponding to the thickness of the toner marking 88. The imaged measurement spots 90' and 92' have a separation D from one another. The quantities H and D stand in an exact proportion defined by the geometry of the optical beam path. The height H, and therewith the thickness of the toner marking 88, can clearly be inferred back from the separation D. The angles 104 and 106 between the scanning beam 84 and the respective middle rays of the radiation beams 100, and 102 also go into the calculation.

The linear detector array 98 transduces the striking radiation into electrical voltages that are processed by a digital signal processor 108 in the form of signal curves. For more precise determination of the positions of the measurement spots 90, and 92 or, respectively, the imaged measurement spots 90' and 92', the center of area of the signal curves over the measurement spots 90', and 92' can be determined. The separation of these centers of area then leads to the quantity D, and therewith indirectly to the quantity H. The determination of the separation H from the separation D of the measurement spots 90', and 92' under consideration of the beam geometry is also designated as a triangulation method. Instead of the mentioned determination of the center, other calculation rules can also be used that yield a clear connection between the quantities D and H. Furthermore, it is possible to determine the quantity H from the quantity D with the aid of a calibration method, without precise knowledge of the beam geometry. Moreover, it is possible to achieve a higher precision with the aid of averaging over a plurality of focal spots along the toner marking 88 or the surface of the intermediate carrier 86.

The mass coating with regard to the area can be determined (in grams per areal unit) via calibration from the thickness H of the toner layer of the toner marking 88. Such a quantity is particularly well-suited to control the print process.

The signal processor 108 forwards the quantities determined by it to the device control for the printer or copier via the line 110. The laser diode 80 (whose output power is typically in the range of 1 mW) is controlled by the signal processor 108 via a controllable power source 111. The current supplied to the laser diode 80 can be measured such that the signal at the detector array 98 lies within a predetermined range. In this manner, an undercontrol and overcontrol can be avoided. Furthermore, the current for the laser diode 80 can be adjusted such that the signal on the side of the detector array 88 remains constant, independent of reflection capability of the toner marking 88 or of the surface of the intermediate carrier 86. Via this measure, the sensor arrangement is independent of the reflection capability of the toner marking 88 or, respectively, the intermediate carrier 86, whereby the signal-to-noise ratio is improved given a scanning of high-contrast surfaces.

To suppress interfering light, a color filter 113 can be connected in front of the detector array 98, preferably a bandpass filter, which is adapted to the wavelength of the radiation of the laser diode 80. Extraneous light is thus filtered out.

Figure 8:
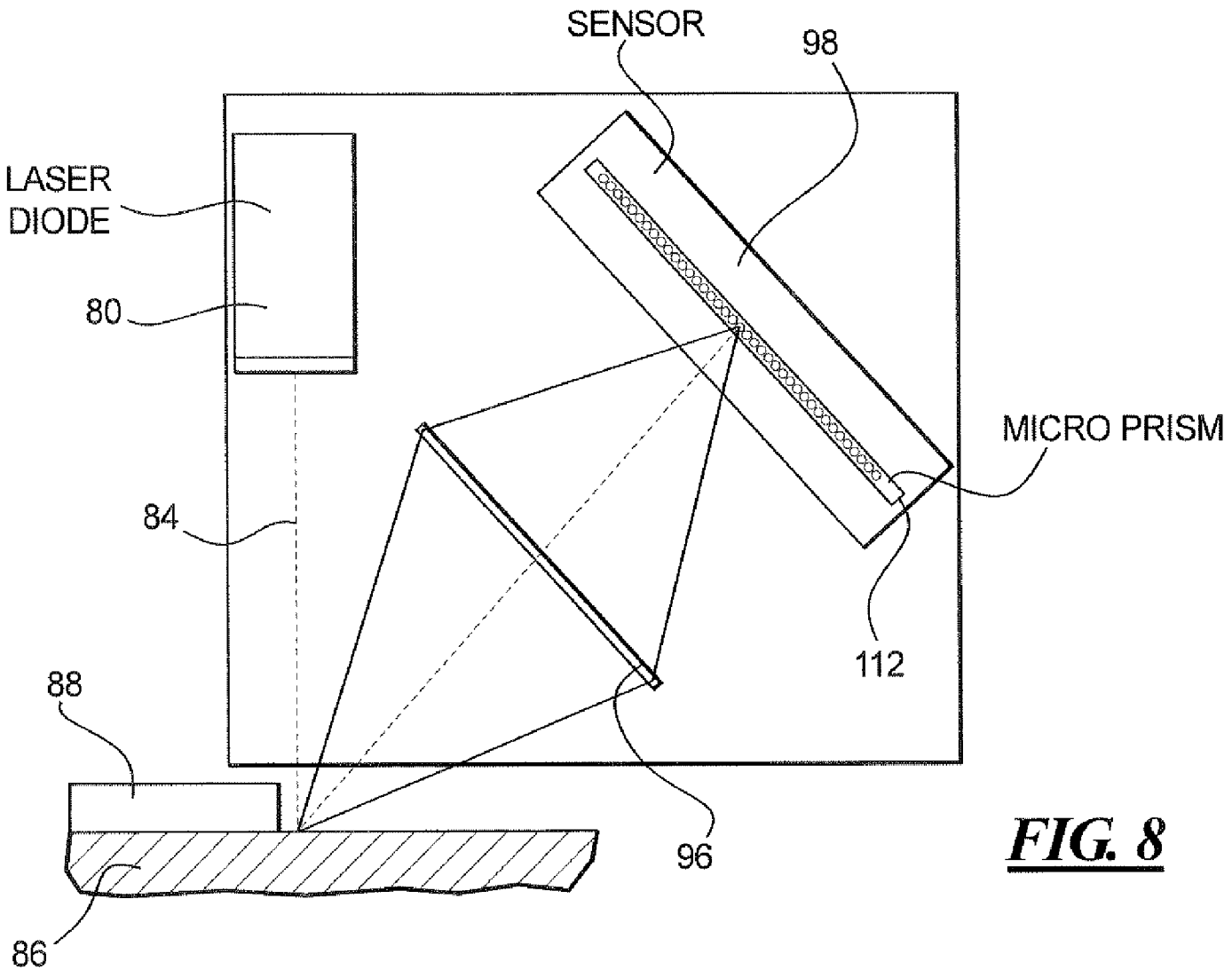
FIG. 8 is a schematic diagram showing the principle assembly of the reflex sensor using micro-optical components.

FIG. 8 shows a further exemplary embodiment of the reflex sensor; identical parts are designated identically. As imaging optics 96, a planar, strip-shaped Fresnel lens is provided that guides the diffuse light originating from the measurement spot to the detector 98 via a microprism 112. The microprism 112 deflects the radiation by 90'. The components Fresnel lens and microprism can be economically produced via casting technique. The assembly can be significantly shrunk and simplified with the arrangement shown in FIG. 8.

Figure 9:
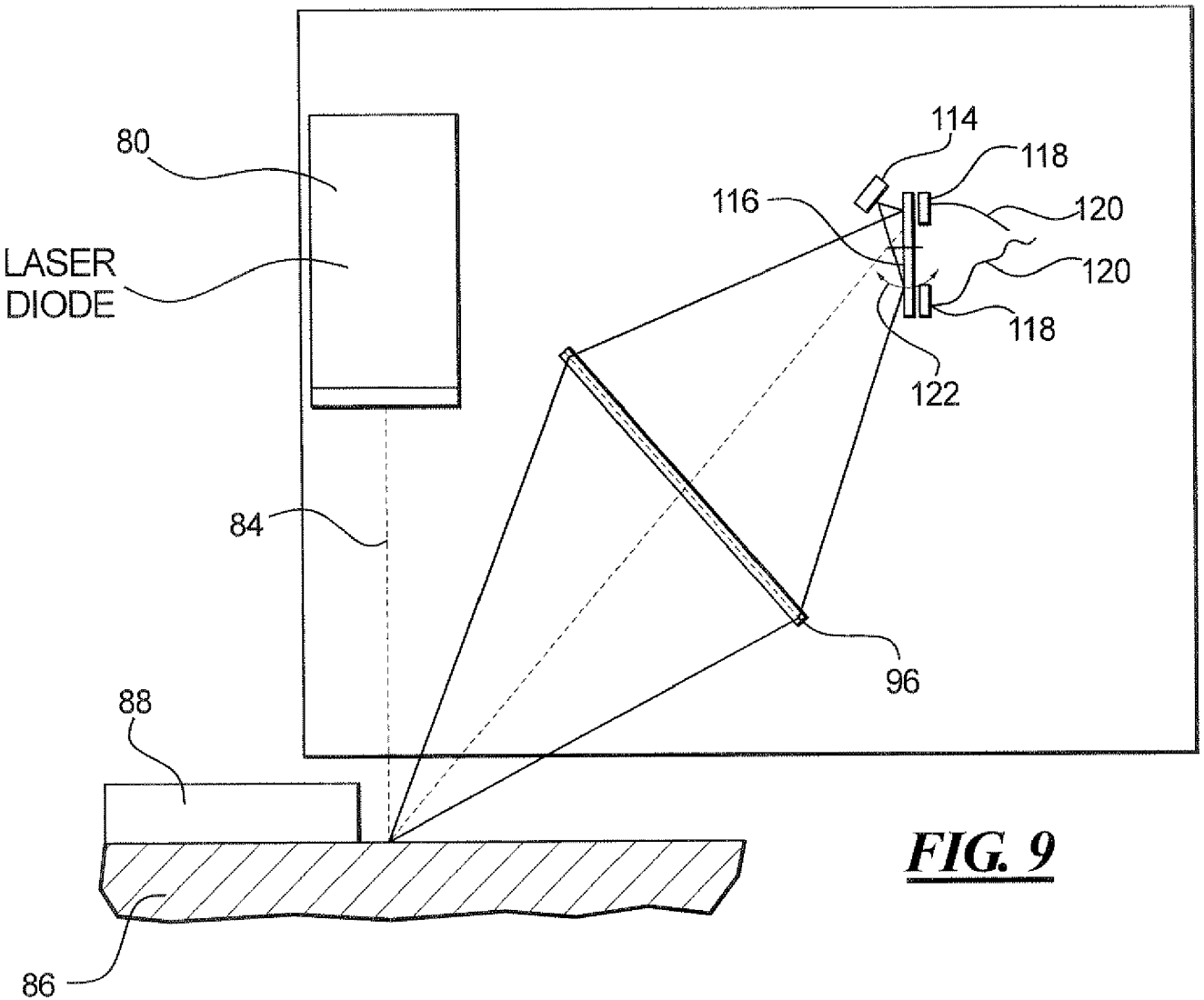
FIG. 9 is a schematic diagram showing an assembly of a reflex sensor using an individual detector with a swing mirror.

FIG. 9 shows a further exemplary embodiment of the reflex sensor, whereby a single detector 1114 (for example a detector that operates according to CMOS technology) is used as a radiation receiver. For reasons of overall size, a Fresnel lens is once again used as the imaging optics 96. The radiation is supplied to the individual detector 114 via a controllable swing mirror 116. This swing mirror is applied to an electrically-conductive substrate with the electrodes 118 and is elastically suspended via torsion springs 120. Via the application of an alternating voltage to the electrodes 118, the swing mirror 116 is displaced according to the arrow 122 in periodic oscillations of constant amplitude. The light impinging on the individual detector 114 therefore has a temporal modulation also corresponding to the electrical signal delivered by it. The time curve of the brightness, and therewith the curve of the measurement spot over the imaging location, is also comprised in this signal, from which the height of the toner marking 88 can be inferred. Another variation provides that the voltage at the electrodes 118 is regulated such that the individual detector 114 always receives the maximum light density of the light guided to it. In this case, the electrode voltages are a measure for the position of the respective measurement spot. As a further alternative, a piezoelectric or an electromagnetic converter can be used as an actuator for the swing mirror 116.

The specified measurement principle is used in connection with the scanning of toner markings on an intermediate carrier 86 that is generally fashioned as a photoconductor, for example as a photoconductor band. Such a photoconductor band as a rule requires a certain relaxation time after the exposure with an intensive radiation source, so that a definite discharge state appears given successive exposure events. If this relaxation time is too short, a memory effect appears, meaning the effect of a plurality of successive exposure events partially adds up, and the photoconductive surface is more deeply discharged than is desired. This memory effect impairs the precision of the measurement effect at the toner marking. To prevent this memory effect, three possibilities are subsequently presented.

A first possibility provides to attenuate or to interrupt the scanning beam. For this, the power supply for the radiation source (for example the laser diode 80) can be connected and disconnected. Another variant is the interruption of the scanning beam 84 with the aid of a mechanical diaphragm, for example by a rotating diaphragm. Another possibility to interrupt the scanning beam 84 is the use of an electro-optical liquid crystal shutter that is switched from a transparent state to a diffuse state upon the application of an electrical voltage, such that the scanning beam 84 is significantly, diffusely scattered, and no tightly-focused measurement spot impinges on the surface of the photoconductor 86. Thus, no measurable discharge of the photoconductor ensues. Such an arrangement requires no moving parts and ensures short reaction times in the range of less than a millisecond.

A second possibility to prevent the memory effect is the position variation of the toner markings. Toner markings are hereby used that have a multiple of the required width of the scanning beam. The scanning beam can then be displaced in its position from rotation to rotation of the photoconductor, for example by at least one track width, such that the relaxation time for the exposed track is extended. The displacement of the scanning beam can, for example, ensue via a mechanical shifting of the sensor head or, respectively, of the radiation source. Another possibility is the rotation of the sensor head or, respectively, of the radiation source around an axis, parallel to the scanning beam 84, that lies outside of the beam axis. A further possibility is the selection of optical means, for example mirrors or prisms, that are moved mechanically.

A third possibility to prevent the memory effect lies in the selection of a wavelength of the radiation for the radiation source for which the photoconductor is not sensitive. When, for example, the photoconductor is sensitive in the long-wave radiation range and insensitive in the short-wave radiation range, no memory effect can be caused given the use of a radiation source with short-wave radiation. Particularly suited as radiation receivers are CCD detectors that, due to their wide-band sensitivity, are appropriate to register radiation in the visible and in the near-infrared range.

The reflex sensor specified in the preceding Figures is suitable to determine both partially-transparent and opaque toner layers of a toner marking of different colors on a background with approximately arbitrary color and reflection property. Due to a thickness measurement, the important quantity for the mass coating of the toner can also be determined.

The specified reflex sensor can be modified in many cases. For example, beam sources with different wavelengths can also be used, whereby an adaptation to the reflection property of the respectively used toner can ensue. For example, the light from two discrete laser diodes coupled in a common beam path can also be used to generate the radiation with two different wavelengths. A semi-permeable mirror is preferably used for this. Given appropriate selection of the wavelengths, the brightness distribution forms two geometric clearly separate brightness maxima on the detector array when the measurement spot scans the edge of the toner marking. The geometric separation of the brightness maxima on the detector array is a measure of the height of the step between the intermediate carrier and the toner marking surface. Also, rastered toner markings can also advantageously be used whose raster width is smaller than the radius of the scanning beam. Two brightness maxima always then arise on the detector when the scanning beam scans the rastered toner marking.

In place of a conventional laser diode with band-shaped light emission and elaborate collimator optics, a vertically emitting laser diode can advantageously be used, what is known as a VCSEL component (VCSEL stands for vertical cavity surface emitting laser diode). The lesser divergence angle and the approximately circular beam cross-section of the VCSEL component requires no or only very simple optical elements for beam shaping.

The specified reflex sensor can be integrated in a simple manner into a CAN network, as this is necessary for controlling more complex electrophotographic printing machines that use networked processor modules over a field bus system. The signal processor 108 then advantageously comprises a corresponding interface to connect to the CAN network.

The specified reflex sensor can also use toner coatings for contrast measurement. For this, given a given exposure strength a cumulative value of the light impinging on the detector array is calculated. In this manner, for example, weakly-reflecting toner coatings can be detected, and these can be utilized to control the print process.

Although other modifications and changes may be suggested by those skilled in the art, it is the intention of the inventors to embody within the patent warranted hereon all changes and modifications as reasonably and properly come within the scope of their contribution to the art

The invention claimed is:

1. A method to control a print or copier, comprising the steps of:

storing marking data for toner markings for a character generator in an image control;

generating a latent image on an intermediate carrier using the character generator corresponding to the marking data;

combining a plurality of markings in the image control into a coherent marking band, each marking having a spatially defined position within the marking band on the intermediate carrier;

inking the marking band with toner material;

scanning the toner markings of the marking band by at least one sensor;

controlling a print process using a signal of the at least one sensor;

storing measurement data for a plurality of toner markings;

assembling at least one marking band from the plurality of toner markings; and selecting an appropriate marking band dependent on a selected print process.

2. A method according to claim 1, further comprising the step of:

defining a single marking band whose toner markings permit a plurality of print processes of a device type to control a printer or copier.

3. A method according to claim 1, further comprising the step of:

applying the at least one marking band with the plurality of toner markings to the intermediate carrier in a region that lies within a print image to be printed in order to be able to implement test functions and compensation functions.

4. A method according to claim 1, further comprising the step of:

applying the at least one marking band to the intermediate carrier along an edge track outside of a print image to be printed in order to not disturb the print image.

5. A method according to claim 1, further comprising the step of:

synchronizing a beginning of the at least one marking band with a beginning of a print side after each print start, a beginning of the marking band coinciding with a beginning of a print side.

6. A method according to claim 1, wherein said at least one marking band comprises a plurality of marking bands, and further comprising the step of:

controlling beginnings of successive ones of said plurality of marking bands by the image control independent of pages to be printed.

7. A method according to claim 6, further comprising the steps of;

synchronizing each of said plurality of marking bands with a beginning of each print side, a beginning of a respective marking band coincides with a beginning of a respective print side.

8. A method according to claim 1, wherein said at least one marking band comprises a plurality of marking bands, and further comprising the steps of:

serially connecting said plurality of marking bands given a greater page length of a print side.

9. A method according to claim 1, further comprising the step of:

combining data for print sides and data for marking bands in a transfer of data to the character generator.

10. A method according to claim 1, further comprising the step of:

combining data of the marking bands and data for the print sides in the image control before generation of image raster data.

11. A method according to claim 1, wherein an electronic diaphragm control acts on the character generator such that the character generator only generates latent images on the intermediate carrier for predetermined toner markings of a marking band.

12. A method according to claim 11, further comprising the step of:

selecting toner markings by a device control depending on a selected print process.

13. A method according to claim 1, further comprising the steps of:

providing a plurality of scanning sensors to scan toner markings;

signaling a beginning of a marking band via a trigger pulse using a device control; and actively switching respective ones of said plurality of scanning sensors with regard to this trigger pulse to scan predetermined toner markings.

14. A method according to claim 1, providing a band shaped intermediate carrier as said intermediate carrier.

15. A method as claimed in claim 14, wherein said intermediate carrier band is an organic photoconductor (OPC) band.

16. A method according to claim 1, further comprising the steps of:

providing two printing units within a device, each of said two printing units having one respective intermediate carrier band;

providing a top of a carrier material with a toner image using an intermediate carrier band;

providing a bottom of the carrier material with a toner image using the other intermediate carrier band; and applying marking bands with toner markings to each intermediate carrier band.

17. A method according to claim 16, wherein said step of applying the marking bands on both intermediate carrier bands ensues such that two toner markings inked with toner are not simultaneously juxtaposed at the common transfer printing location for both transfer bands.

18. A method according to claim 1, further comprising the step of:

selecting a length of the marking band such that it is not an even-number multiple of a length of the intermediate carrier.

19. A method according to claim 1, further comprising the steps of:

determining a thickness of a toner layer of the toner marking according to a triangulation method using an optical reflex sensor as a sensor to scan respective toner marking; and controlling the print process dependent on a determined thickness of the toner layer.

20. A method according to claim 19, wherein said optical reflex sensor includes:

at least one laser diode that radiates radiation in a direction of the toner marking as a radiation source; and one of a linear detector array and a two-dimensional detector array as a receiver.

21. A method according to claim 20, further comprising the steps of:

generating at least one measurement spot using at least one laser diode; and imaging said at least one measuring spot on said one of said linear detector array and said two-dimensional detector array via a lens.

22. A method according to claim 21, further comprising the steps of:

determining a curve of brightness along the respective measurement spot for each measurement spot; and determining a center of the respective measurement spot dependent on the curve; and determining a thickness of the toner layer dependent on the separation between the centers of the measurement spots.

23. A method according to claim 22, further comprising the step of:

using a balance point of the curve of the brightness as a center for the respective measurement spot.

24. A method according to claim 21, further comprising the step of:

varying a position of said at least one measurement spot on the toner marking from rotation to rotation of the intermediate carrier.

25. A method according to claim 20, further comprising the step of:

using a controlled power supply for the laser diode; and measuring supplied current such that the signal of said one of said linear detector array and said two-dimensional detector array lies within a predetermined range.

26. A method according to claim 20, further comprising the step of:

adjusting current for the laser diode such that a signal on a side of the receiver remains constant and independent of the reflection property of at least one of toner marking and the intermediate carrier.

27. A method as claimed in claim 26, wherein said intermediate carrier is a photoconductor surface.

28. A method according to claim 20, wherein a beam emitted by the laser diode is one of attenuated and interrupted.

29. A method according to claim 28, further comprising the step of:

interrupting the beam using a mechanical diaphragm.

30. A method according to claim 28, further comprising the step of:

interrupting the beam using a voltage-controlled liquid crystal shutter.

31. A method according to claim 19, further comprising the step of:

determining a mass coating with regard to area is determined from the thickness of the toner layer via calibration.

32. A method as claimed in claim 31, wherein said determining step determines the mass coating in grams per unit area of the toner.

33. A method according to claim 19, wherein said reflex sensor includes a color filter on a receiver side via which extraneous light is suppressed.

34. A method as claimed in claim 33, wherein said color filter is a bandpass filter.

35. A method according to claim 19, further comprising the step of:

using a radiation source as the reflex sensor having a radiation wavelength outside of a sensitivity range for the wavelength of the light of said intermediate carrier.

36. A method according to claim 19, wherein said radiation source of the reflex sensor radiates radiation with two different wavelengths.

37. A method according to claim 36, further comprising the steps of:

coupling the radiation of two laser diodes in a mutual beam path to generate the radiation of different wavelengths.

38. A method as claimed in claim 37, wherein said step of coupling uses semi-permeable mirrors.

39. A method according to claim 19, further comprising the step of:

using a vertical cavity surface emitting laser diode (VCSEL) radiation source as a radiation source.

40. A method according to claim 19, further comprising the step of:

using an individual radiation receiver on the receiver side to which radiation is supplied via a mirror that can be varied with regard to its angle of rotation.

41. A device to control a print or copier, comprising:

an intermediate carrier;

an image control operable to control storage of marking data for toner markings;

a character generator connected to said image control and operable to generate a latent image on said intermediate carrier corresponding to the marking data;

said image control being operable to combine a plurality of markings into a coherent marking band, each marking having a spatially defined position within the marking band on the intermediate carrier;

an inking apparatus positioned adjacent to said intermediate carrier and operable to ink the latent image with toner material;

at least one sensor operable to scan the toner markings of the marking band and connected to provide an output signal to control the print process; and a storage in which measurement data are stored for a plurality of toner markings;

said image control being operable to assemble at least one marking band from said plurality of toner markings, an appropriate marking band being selected dependent on a selected print process.

42. A device according to claim 41, wherein a single marking band is defined whose toner markings permit the plurality of print processes of a device type to control a printer or copier.

43. A device according to claim 41, wherein the at least one marking band with the plurality of toner markings is applied to the intermediate carrier in a region that lies within the print image to be printed, in order to be able to implement test functions and compensation functions.

44. A device according to claim 41, wherein the at least one marking band is applied to the intermediate carrier along an edge track outside of the print image to be printed, in order to not disturb the print images.

45. A device according to claim 41, wherein a beginning of a first marking band is synchronized with a beginning of a first print side after each print start, whereby the beginning of the first marking band preferably coincides with the beginning of the first print side.

46. A device according claim 41, wherein the image control administrates the beginnings of the successive marking bands independent of pages to be printed.

47. A device according to claim 46, wherein each marking band is synchronized with the beginning of each print side, whereby the beginning of the respective marking band preferably coincides with the beginning of the respective print side.

48. A device according to claim 41, wherein a plurality of marking bands are connected serially given a greater page length of a print side.

49. A device according to claim 41, wherein the data for print sides and the data for marking bands are combined in the transfer of the data to the character generator.

50. A device according to claim 41, wherein the data of marking bands and the data for print sides are combined in the image control before the generation of image raster data.

51. A device according to claim 41, further comprising:

an electronic diaphragm control acts on the character generator such that the character generator only generates latent images on the intermediate carrier from predetermined toner markings of a marking band.

52. A device according to claim 41, further comprising:

a plurality of scanning sensors are provided to scan toner markings;

a device control signals the beginning of a marking band via a trigger pulse; and the respective scanning sensor is actively switched with regard to this trigger pulse to scan predetermined toner markings.

53. A device according to claim 41, wherein said intermediate carrier is an intermediate carrier band of an organic photoconductor (OPC).

54. A device according to claim 41, further comprising:

two printing units, with respectively one intermediate carrier band, are provided within a device, whereby an intermediate carrier band provides the top of a carrier material with a toner image, and the other intermediate carrier band provides the bottom of the carrier material with a toner image, and in which marking bands with toner markings are applied to each intermediate carrier band.

55. A device according to claim 54, in which the application of the marking bands on both intermediate carrier bands ensues such that two toner markings inked with toner are not simultaneously juxtaposed at the common transfer printing location for both transfer bands.

56. A device according to claim 41, wherein a length of the marking band is selected such that it is not an even-number multiple of the length of the intermediate carrier.

57. A device according to claim 41, further comprising:

an optical reflex sensor that determines a thickness of a toner layer of the toner marking according to the triangulation method is used as a sensor to scan the respective toner marking, and that the print process is controlled dependent on the determined thickness of the toner layer.

* * * * *